US006945620B2

(12) United States Patent
Lam et al.

(10) Patent No.: US 6,945,620 B2
(45) Date of Patent: Sep. 20, 2005

(54) GUIDE RAILS FOR PULL-OUT DRAWER/ EQUIPMENT

(75) Inventors: Harn Lian Lam, Ipoh (MY); Harn Yan Lam, Ipoh (MY)

(73) Assignee: Harn Marketing Sdn Bhd, Perak (MY)

( * ) Notice: Subject to any disclaimer, the term of this patent is extended or adjusted under 35 U.S.C. 154(b) by 0 days.

(21) Appl. No.: 10/440,413

(22) Filed: May 19, 2003

(65) Prior Publication Data

US 2004/0000851 A1 Jan. 1, 2004

(30) Foreign Application Priority Data

May 17, 2002 (MY) ..... PI 2002 1818

(51) Int. Cl.[7] ..... A47B 88/00

(52) U.S. Cl. ..... 312/334.6; 312/334.31; 312/334.7; 312/334.12; 312/334.33; 312/334.39; 384/18; 384/19

(58) Field of Search ..... 312/334.6, 334.7, 312/334.12, 334.14, 334.15, 334.18, 334.33, 334.39; 384/18, 19, 21

(56) References Cited

U.S. PATENT DOCUMENTS 4,480,878 A * 11/1984 Leiper ..... 384/19
4,606,588 A * 8/1986 Koch ..... 384/18
4,752,143 A * 6/1988 Lautenschlager, Jr. ..... 384/19
5,020,869 A * 6/1991 Faust ..... 312/334.15
5,207,781 A 5/1993 Rock
5,882,100 A * 3/1999 Rock ..... 312/334.34
6,132,020 A * 10/2000 Schael et al. ..... 312/334.1
6,588,866 B2 * 7/2003 Cheng ..... 312/334.7

FOREIGN PATENT DOCUMENTS

| | | |
|---|---|---|
| EP | 0 391 221 | 3/1990 |
| EP | 0 927 530 | 11/1998 |
| GB | 1117071 | 6/1968 |
| WO | WO 92/00027 | 1/1992 |

OTHER PUBLICATIONS

U.S. Appl. No. 10/440,415, filed May 19, 2003, Harn et al.

* cited by examiner

*Primary Examiner*—Laurie K. Cranmer
(74) *Attorney, Agent, or Firm*—Volpe and Koenig, P.C.

(57) ABSTRACT

A sliding guide rail assembly (20, 20*a*, 20*b*) is provided for slidably mounting a drawer or equipment (10) within a cabinet or chassis. The rail (33*a*) is formed from a sheet metal into a T-shaped section onto which a sliding means (40, 40*a*, 40*b*, 40*c*) fits and slides smoothly thereon. Guides (50, 120, 150, 160) also formed from a sheet metal into C-sections fitting over the sliding means (40, 40*a*, 40*b*, 40*c*) and operable to slide smoothly therewith. This enables the drawer/equipment mounted on the slide (20, 20*a*, 20*b*) to be drawn in and out with little effort or wear and tear.

9 Claims, 12 Drawing Sheets

151
152
150
153
121
120
110
112
111
113
114
115
44
40b
41
42
43
40a
145
144
148
147
149
140
141
143
142
33a

GUIDE RAILS FOR PULL-OUT DRAWER/ EQUIPMENT

FIELD OF THE INVENTION

This invention relates to the sliding guide rails for pull-out drawers and/or equipment from their cabinets/chassis.

BACKGROUND OF THE INVENTION

Guide rails are components in common every day use, such as for drawers in desks or cabinets, and for industrial use such as pull-out storage shelves at the warehouse, cash registers at the supermarket, automated teller machines at the banking kiosks, electronic equipment at the telephone switching stations and so on. These guide rails provide frictionless rolling means and they enable us, for example, to pull out our drawers with little effort, and to reduce the pulling force required for operating the cash registers or shelves at the warehouses.

Guide rails are provided for drawers to be either partially or fully opened. For other applications, such as the automated teller machines, they may have to be fully pulled out from their chassis for purposes of regular maintenance. In the latter case, over travel is typically provided by the guide rails.

In most applications, these guide rails are preferred to be compact and allow maximum use of the available space. The primary requirements are their strength and rigidity. In most cases, these guides are thin and wide, and are usually installed vertically because of their greater rigidity in this position. However, when installed in the horizontal position, the strength and rigidity are very much reduced. Other requirements may be the ease of installation and/or alignment.

The cost of a guide rail is also an important consideration. This depends on the construction of the rail such as on the number of components, manufacturing costs and/or installation costs.

SUMMARY OF THE INVENTION

According to a first embodiment of the present invention there is provided a sliding guide assembly for supporting a drawer/equipment for slidably opening and closing within a cabinet or chassis comprising:

a mounting bracket having at least two flanges, one flange for mounting to a part of said cabinet or chassis, and the other flange has its edge formed into a T-rail, and on the central web (36) adjacent said T -rail are formed a pair of limit stoppers;

a housing having sliding means fitting on said T-rail and being operable to slide smoothly thereon, with the distance of travel limited between said stoppers; and a pull-out guide having a C-section fitting over said slide housing and being operable to slide smoothly therewith between a pair of limit stoppers;

wherein the pull-out guide is attached to the drawer/equipment, and the travel of said slide is given by the total distance between the stoppers on the said T-rail and said pull-out guide minus twice the length of the said housing means.

According to a second embodiment of this invention is provided a sliding guide comprising:

a mounting bracket in the form of an L-section having a vertical flange for mounting to a part of said cabinet or chassis and a horizontal flange;

a fixed guide having a pair of limit stoppers and mounted along said horizontal flange;

a first and a second sliding housing means;

an intermediate I-rail integrally comprising upper and lower T-rails and having two pairs of limit stoppers adjacent said T-rails; and a pull-out guide having a pair of limit stoppers;

wherein said first sliding housing means is operable to fit and slide smoothly on said lower T-rail and to fit and slide smoothly within said guide between said stoppers, whilst the second housing means is operable to fit and slide smoothly on said upper Trail and to fit and slide smoothly within said guide between said stoppers; and the travel is given by the total distances between the said stoppers of the said fixed guide, said intermediate I-rail and said pull-out guide minus three times the length of said housing means.

According to a third embodiment, a sliding guide is provided and comprising:

a mounting bracket having at least two flanges, one flange for mounting to a part of said cabinet or chassis, and the other flange with its edge formed into a T-rail and having a pair of limit stoppers **(39*a*) adjacent said T -rail (33*a*)**;

a first sliding housing means fitting on said T-rail and being operable to slide smoothly thereon, with the distance of travel limited between said stoppers;

a pull-out guide in the form of a C-section fitting over said housing means and being operable to slide smoothly therewith between a pair of stoppers, on either or both vertical flanges, said pull-out guide having a further pair of stoppers on the horizontal flange of said pull-out guide;

a second sliding housing means fitting over said pull-out guide and being operable to slide smoothly thereon between said stoppers; and a pull-out guide of C-section having locating means and fitting over said second sliding housing means and being operable to slide smoothly therewith between a pair of stoppers;

wherein said second pull-out guide is attached at the bottom of said drawer by said locating means, and the travel of the slide is given by the total distances between the said stoppers of the said T-rail and said pull-out guides and minus the lengths of said housing means.

Preferably, the mounting brackets and sliding guides are formed from sheet metals.

Preferably, the T-rails have flanges of equal widths on both sides of the central web. These flanges may be folded at either side of the vertical web, or on both sides.

BRIEF DESCRIPTION OF THE DRAWINGS

This invention will now be further described by way of non-limitative examples, with reference to the accompanying drawings, in which.

Figure 3:
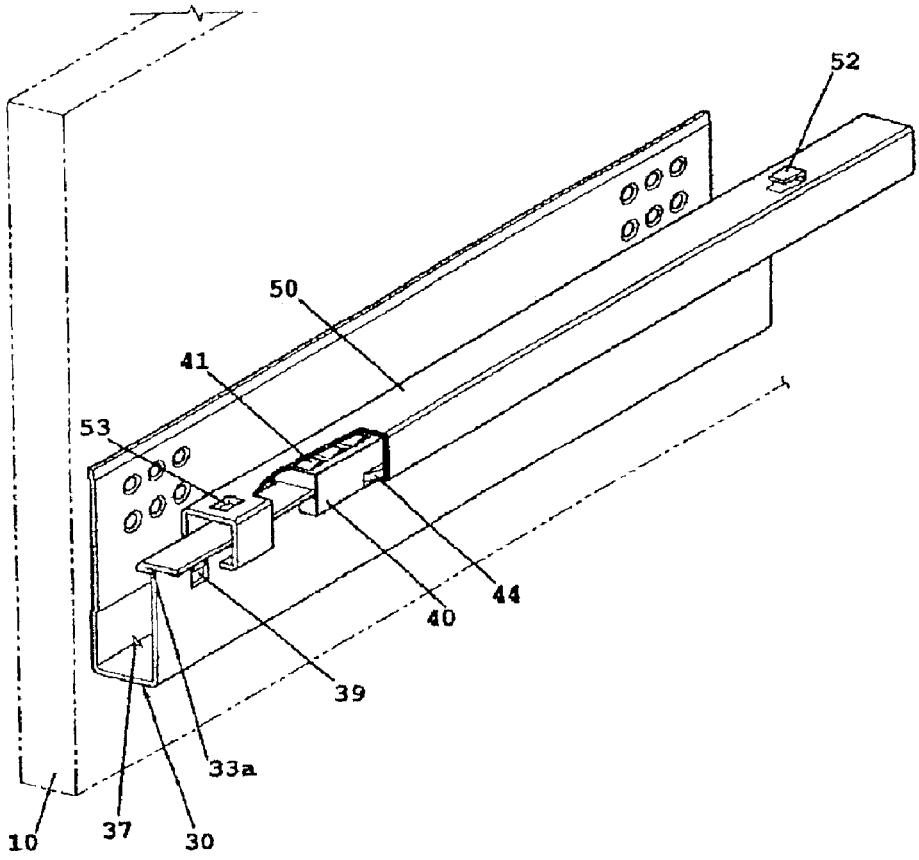
FIG. 3 is a perspective view of an assembled sliding rail according to the first embodiment.

FIG. **4*a* illustrates the fixed member of the sliding rail shown in FIG. 3**.

FIG. **4*b* illustrates the roller housing of the sliding rail shown in FIG. 3**.

Figure 4C:
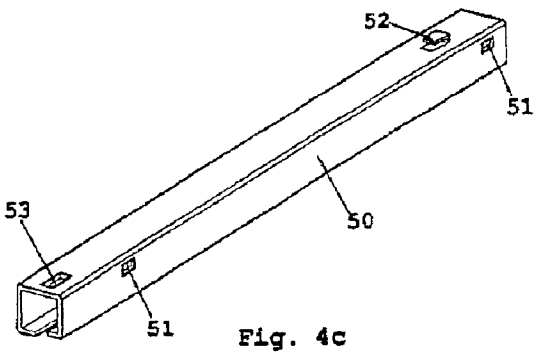

FIG. 4*c* illustrates the pull-out guide of the sliding rail shown in FIG. 3.

Figure 1:
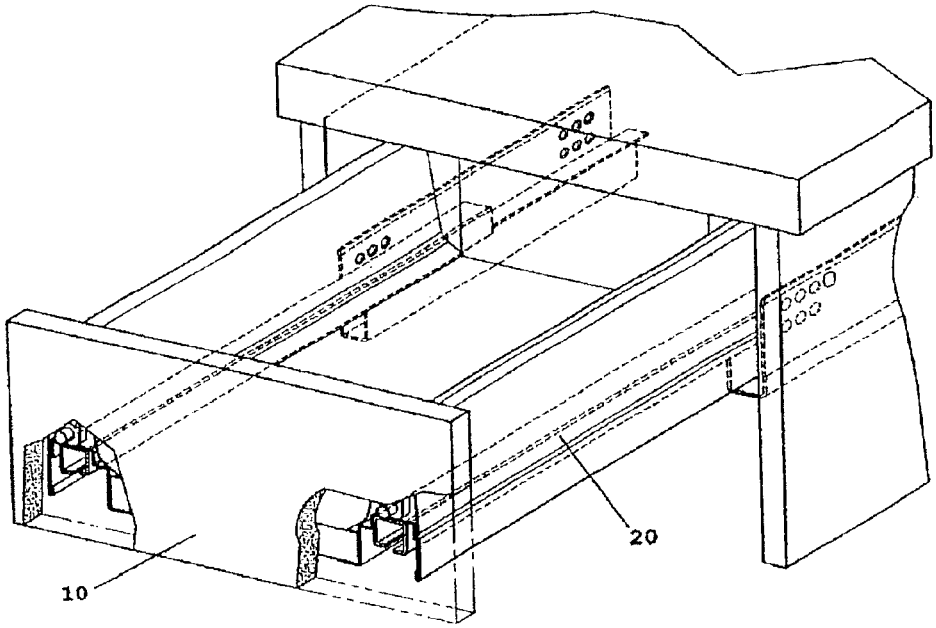
FIG. 1 illustrates a drawer incorporating a sliding rail according to a first embodiment of the present invention.
Figures 5A, 5B, 5C:
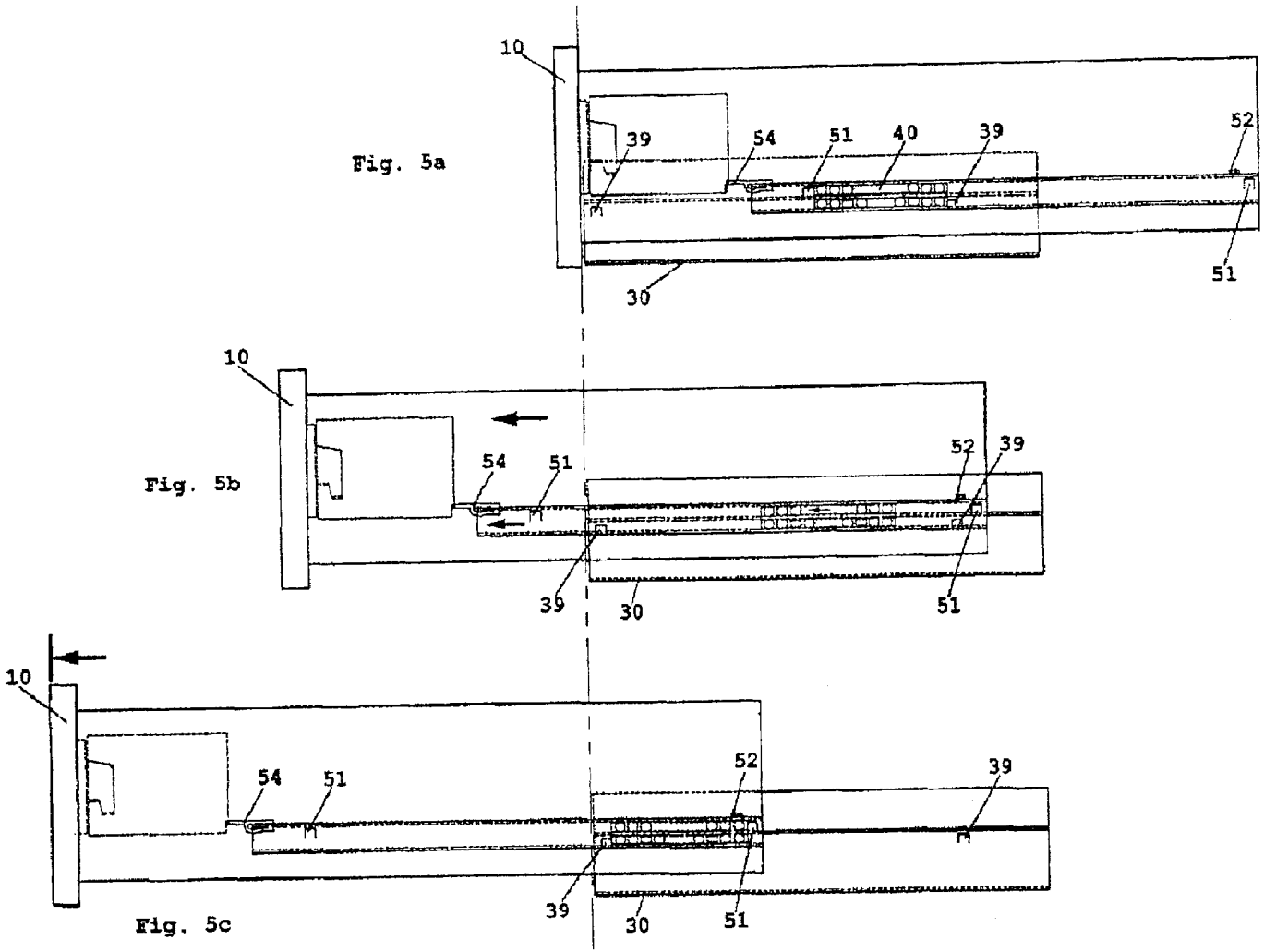

FIG. 5*a* illustrates a drawer shown in FIG. 1 in its closed position.

FIG. 5*b* illustrates a drawer shown in FIG. 1 at an intermediate open position.

FIG. 5*c* illustrates a drawer shown in FIG. 1 in its fully opened position.

Figure 6:
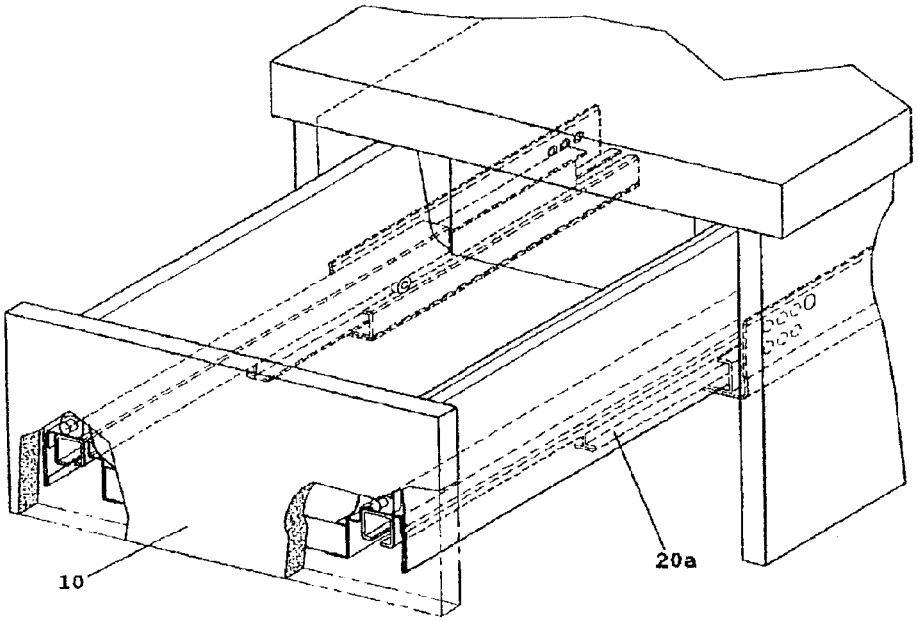

FIG. 6 illustrates a drawer incorporating a sliding rail according to a second embodiment of the present invention.

Figure 7:
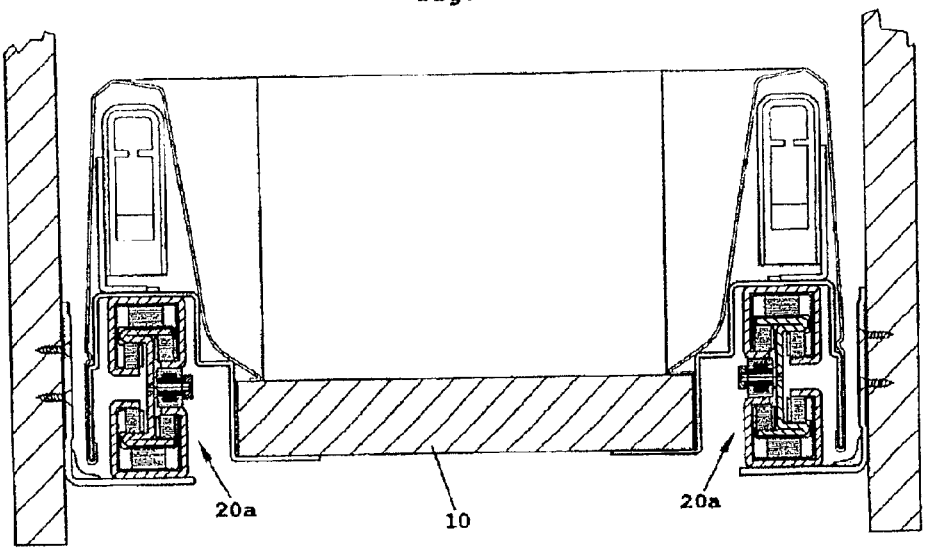

FIG. 7 is a sectional view of the drawer shown in FIG. 6.

Figure 8:
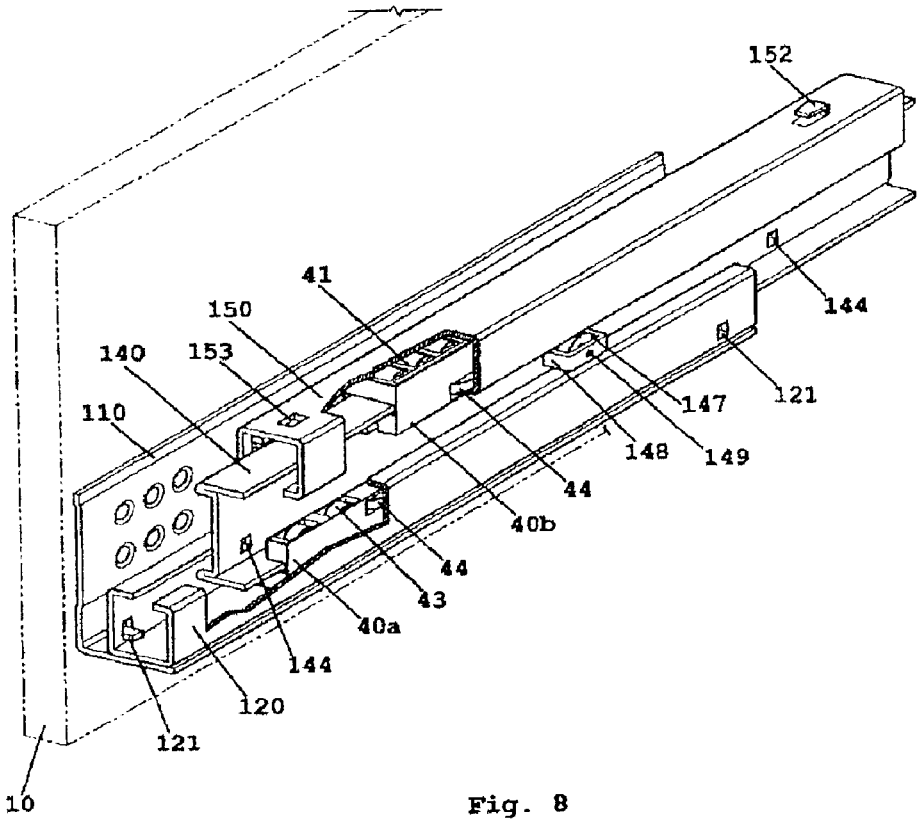

FIG. 8 is a perspective view of a sliding rail assembly according to the second embodiment.

Figures 9A, 9B, 9C, 9D, 9E, 9F:
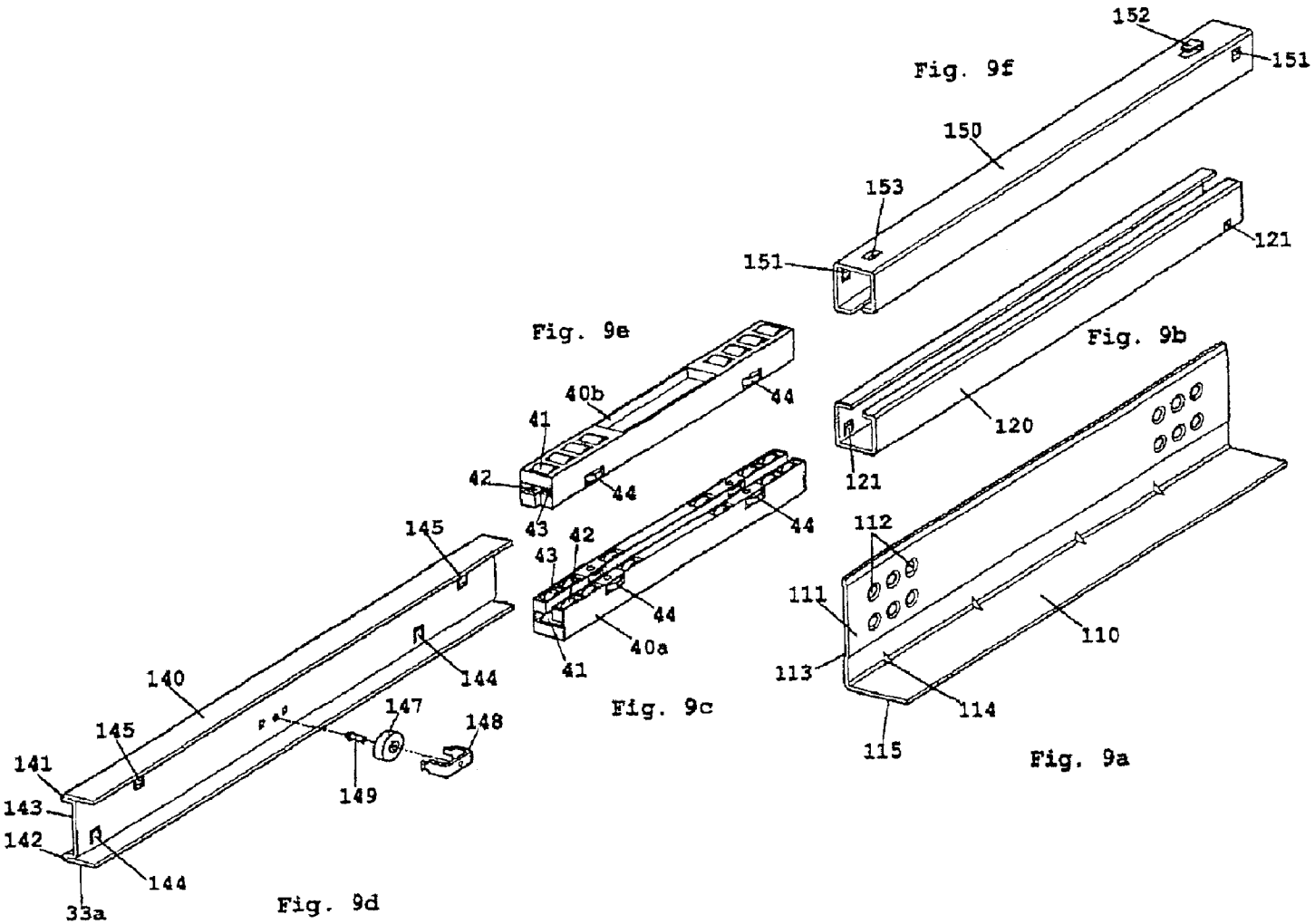

FIG. 9*a* illustrates the fixed member shown in FIG. 8.

FIG. 9*b* illustrates the fixed guide shown in FIG. 8.

FIG. 9*c* illustrates the lower roller housing shown in FIG. 8.

FIG. 9*d* illustrates the intermediate guide shown in FIG. 8.

FIG. 9*e* illustrates the upper roller housing shown in FIG. 8.

FIG. 9*f* illustrates the pull-out guide shown in FIG. 8.

Figure 10:
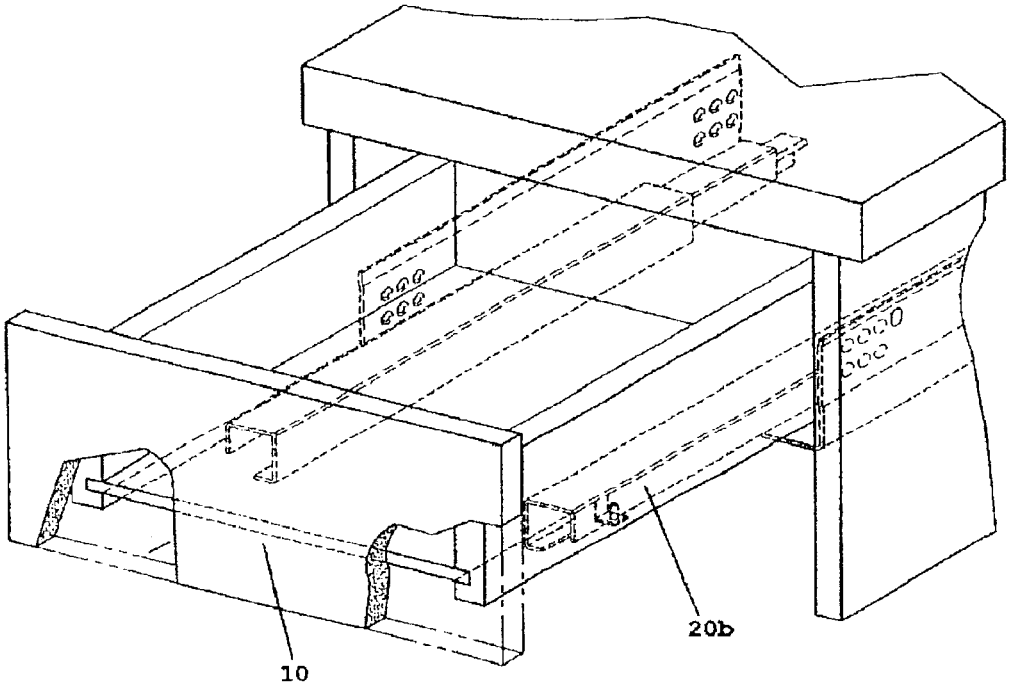

FIG. 10 illustrates a drawer incorporating a sliding rail according to a third embodiment of the present invention.

Figure 11:
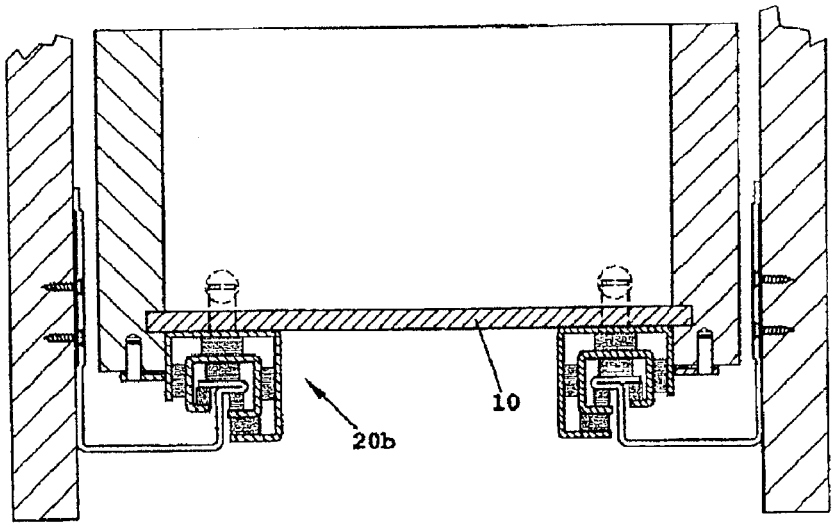

FIG. 11 is a sectional view of the drawer shown in FIG. 10.

Figure 12:
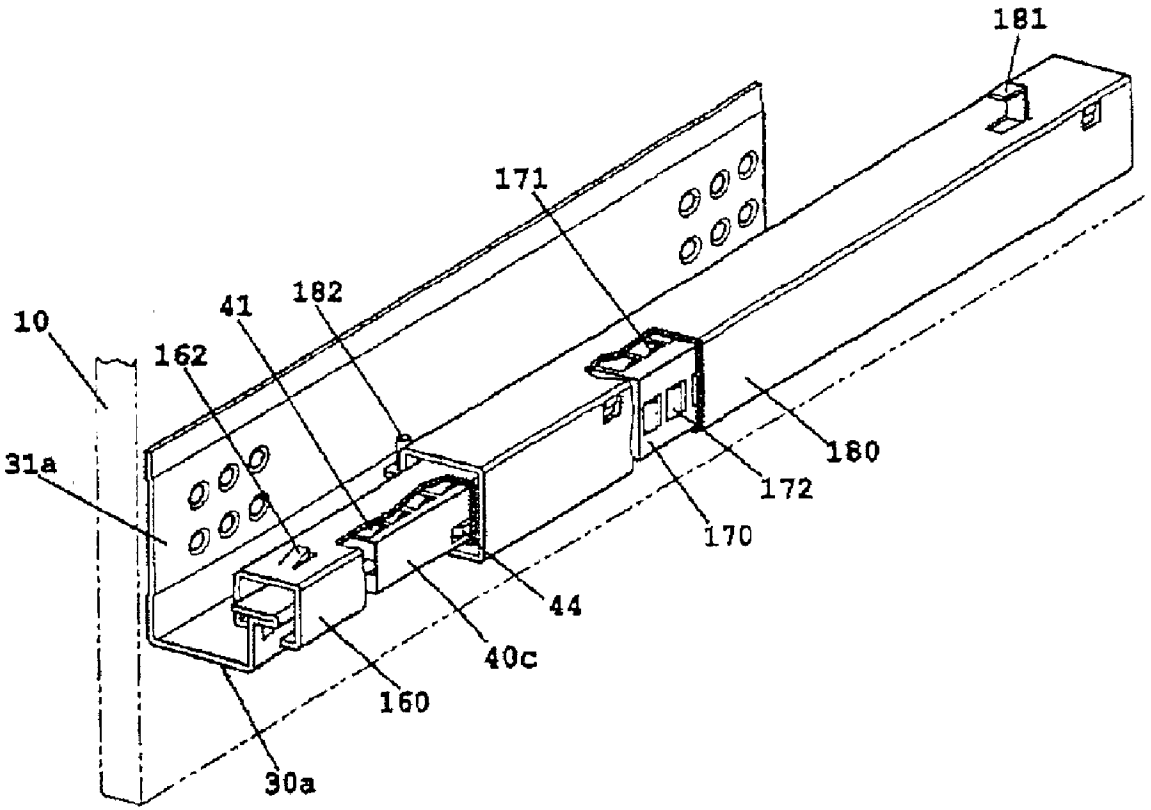

FIG. 12 is a perspective view of a sliding rail assembly according to the third embodiment.

FIGS. 13*a*–13*e* illustrate the individual parts of the sliding rail shown in FIG. 12.

Figure 14:
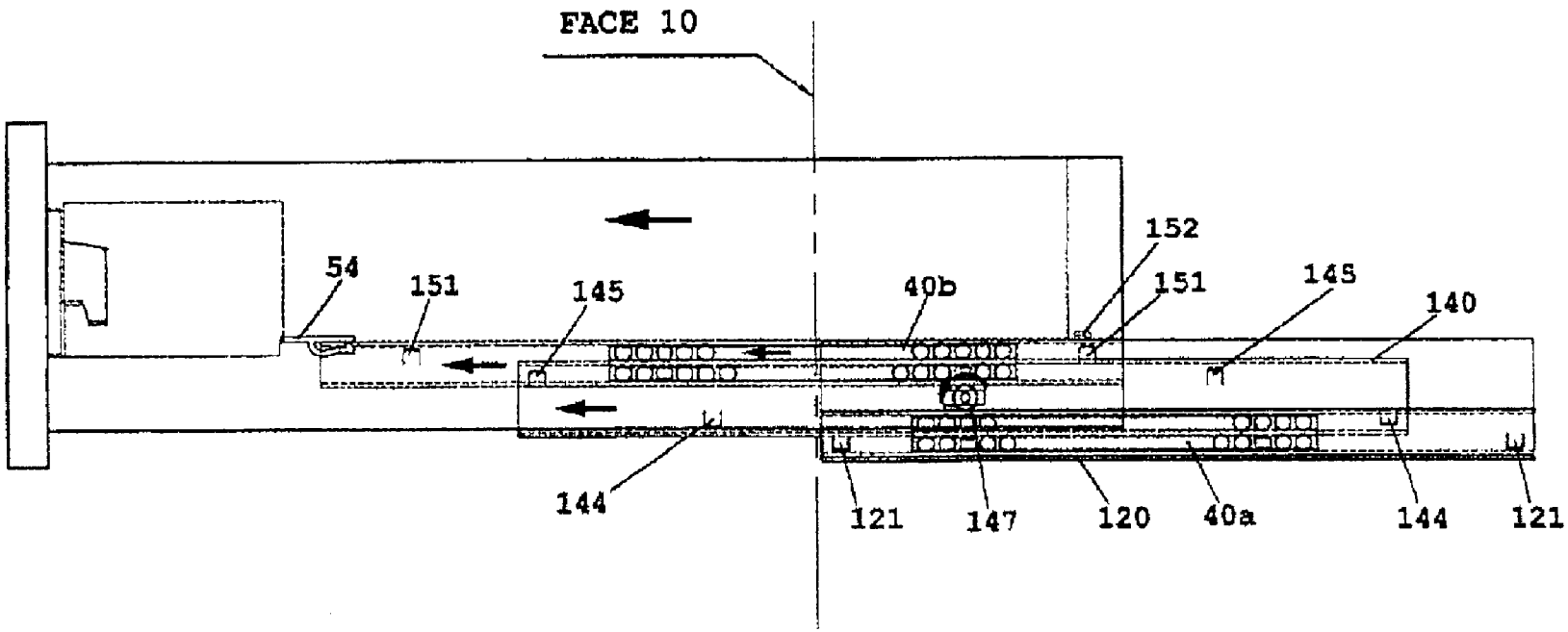

FIG. 14 illustrates a drawer shown in FIG. 6 at an intermediate open position.

Figure 15:
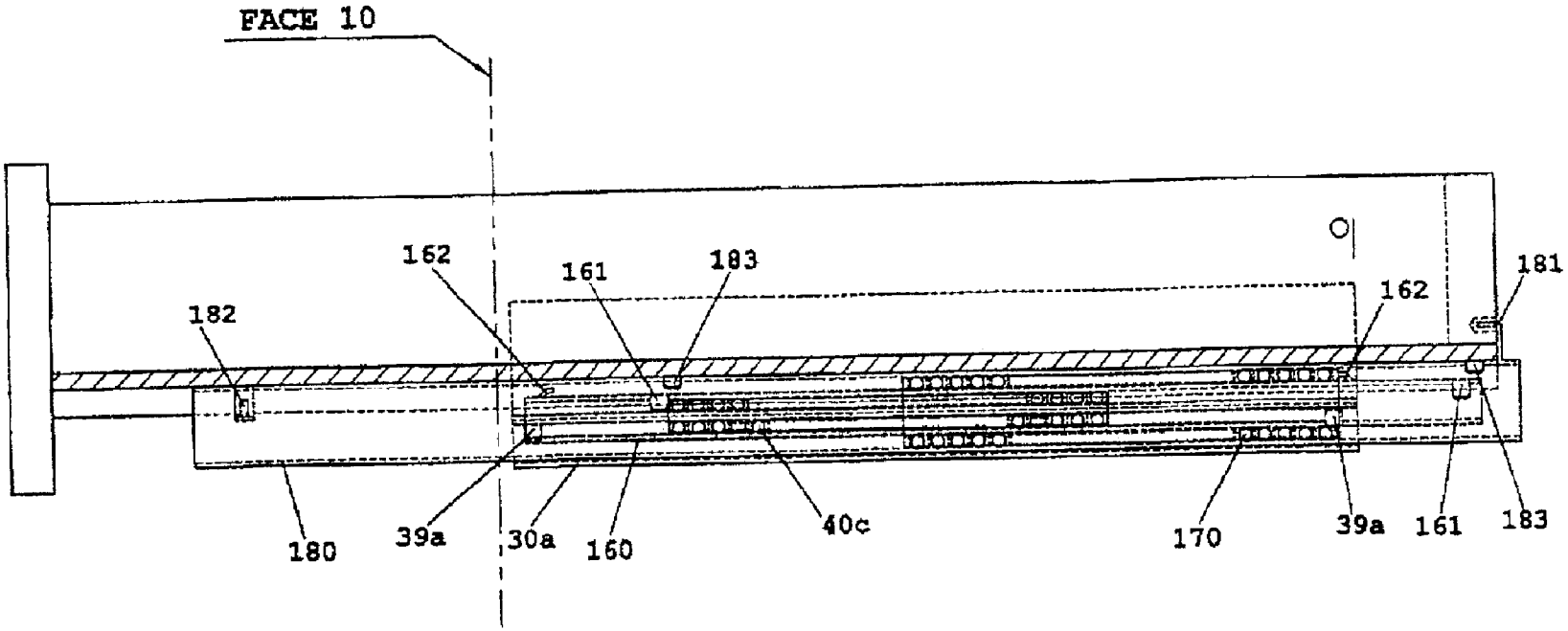

FIG. 15 illustrates a drawer shown in FIG. 10 at an intermediate open position.

DESCRIPTION OF EMBODIMENTS OF THE INVENTION

Figure 2:
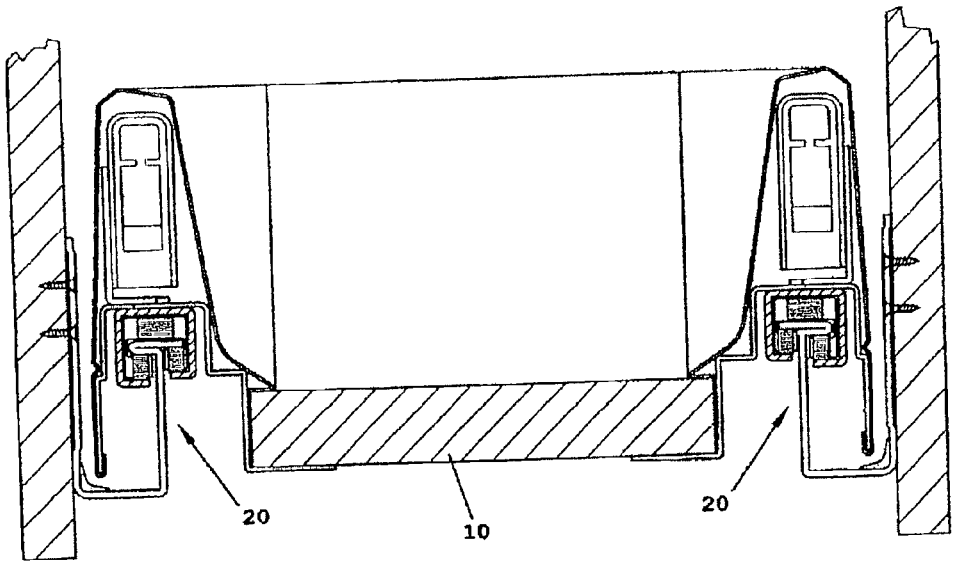
FIG. 2 is a sectional view of a drawer shown in FIG. 1.

Referring to FIG. 1, a slide rail assembly 20 according to the first embodiment is installed at each of the two sides of a drawer or slid able storage compartment/equipment 10. The sectional view of the drawer assembly, illustrated in FIG. 2, shows each slide rail comprising of a fixed support member 30; a roller housing 40; and a pull-out guide 50. FIG. 3 shows a perspective view of the slide rail assembly.

The fixed support member 30 is formed from a sheet metal into a substantially U shaped section. The longer flange 31 of the U has a multitude of holes 32 for mounting this support member 30 onto the inner side of a cabinet, for example, where a drawer or piece of equipment is to be slidably installed into. The other flange 33 is shorter and substantially parallel to flange 31. The long edge of flange 33 is formed into a T shaped rail 33*a*, with the horizontal legs 34, 35 of the T being substantially equal in width from either side of the vertical leg or web 36.

The centre part of the U-section is perpendicular to both flanges 31 and 33. In order to give these bent edges rigidity, notches 37 are formed at regular intervals along the bent edges.

To increase the rigidity of flange 31, stepped edges 38, with heights of substantially half the thickness of the sheet metal, are formed on it. The stepped edges 38 may simply be a pair of parallel edges formed along the long side or depressed areas of a few $cm^2$ of any shape formed at regular spaced intervals.

Below the T-shaped rail of flange 33 and towards each of the two ends is a cut 39 in the shape of a U. The tongues of the U are bent inwardly and these serve as the limit stoppers 39 for the roller housing 40. The distance $L_1$ between the stoppers determines the opening or pull-out travel of the drawer/equipment mounted on these slide rails 20. The tongues of 39 are preferably bent inward. This is to prevent the hands of the persons installing these slides or using the drawer or machine employing such slides from accidental cuts. However, these tongues can be bent outward without affecting their function as stoppers.

Figure 4B:
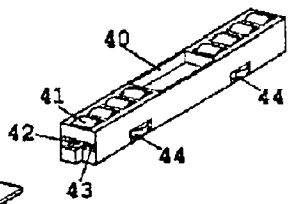

The roller housing 40 is a long member of length $L_2$ and is substantially of rectangular cross-section. The centre is substantially hollow and is in the form of an open T. Rollers 41 are provided at the upper part of the T, whilst rollers 42, 43 are provided parallel to rollers 41 but at both sides of the T. These rollers 42 and 43 are relatively displaced in the vertical direction by substantially the thickness of flange 33. Depending on the loading capacity for which the slide is designed for, there may be a plurality of rollers 41,42,43 (as shown in FIG. 4*b*) or at least one of each type of rollers at each end of the housing 40.

On each side of the roller housing 40 are at least two further side rollers 44 spaced apart as far as possible without interfering with the rollers 41,42,43. A similar arrangement is provided at the opposite side of housing 40. These side rollers 44 provide lateral guidance for the drawer/equipment. When these rollers 44 are spaced as far apart as possible, they provide greater lateral stability.

In this embodiment, the slides provide only partial opening of a drawer and therefore the primary load is on rollers 41. This means that more rollers 41 may be provided than rollers 42 or 43.

These rollers and the support parts of the housing are sized to withstand their designed loads. Rollers of appropriate size bigger than the supporting parts are selected so that the rolling planes of the rollers have sufficient clearance from the body of housing 40.

Figure 4A:
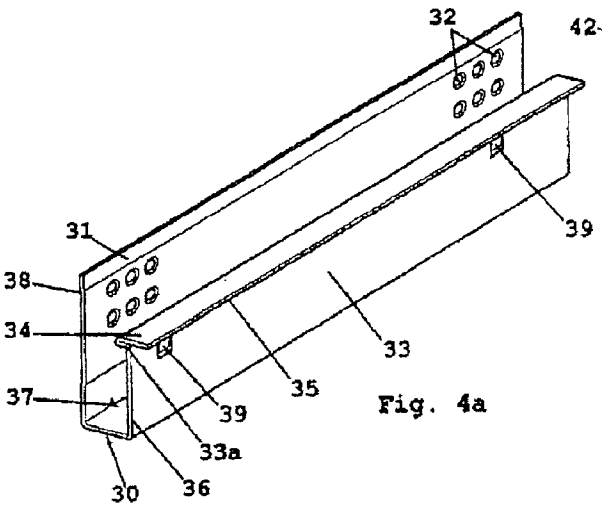

The open T-recess at the centre of housing 40 fits onto the T-shaped rail 33*a* formed on flange 33. Rollers 41 inside the housing run on the upper, horizontal flange 34,35 of the T-rail, whilst rollers 42 run on the lower surfaces of flange 34 and rollers 43 on the lower surface of flange 35. Of course, some clearances are provided between rollers 42, 43 and the lower surfaces of flanges 34, 35 for ease of alignment and/or assembly. Similarly, some clearances are provided between rollers 44 and the surfaces of the vertical web 36. Obviously, if the T-rail 33*a* is formed with the folded edge at the right hand side of flange 33 (as opposed to that shown in FIG. 4*a*), then the roller housing 40 would have to be turned around.

Pull-out guide 50 is formed from a sheet metal into an open C-section having unequal sides. Guide 50 encloses roller housing 40 and slides smoothly on rollers 41,42,43,44. On either side of guide 50 are two U cuts, one towards each of the ends, with the tongues bent inwardly to form stoppers 51. The distance $L_3$ between these stoppers 51 determines the travel of the slide rail 20. On the upper surface at the rear end of 50 is cut and formed an L-shape extension 52. This extension 52 engages with an attachment (not shown) on the sideboard of drawer 10 for fixing this guide 50 to the drawer. At the outer end of guide 50 is punched an aperture 53 for engagement with a catch 54 (shown in FIG. 5) mounted at the forward sideboard of this drawer. In this way, the drawer can be easily and removeably attached to the pull-out guide 50.

A variation of a T-rail having flange 35*a* (not shown) folded may be provided. In this case, the T-recess of roller housing is symmetrical and the axes of rollers 42,43 are inline with each other. It follows that the C-section of the pull-out guide has also symmetrical sides.

With a pair of guide rails 20 installed at the sides of drawer 10, the drawer is then fully supported and can be slidably opened and closed with little effort. FIGS. 5*a* to 5*c* illustrate the closed, intermediate and fully opened positions of a drawer. The travel of the drawer is determined by $L_1+L_3-2L_2$.

FIG. 6 shows a second embodiment of a sliding guide 20*a*. This sliding guide 20*a* comprises of a fixed support bracket 110; a fixed sliding guide 120; a lower roller housing 40*a*; a pull-out slide rail 140; an upper roller housing 40*b*; and a pull-out guide 150. FIG. 7 illustrates a sectional view of this embodiment, while FIG. 8 shows a perspective view of an assembled slide rail 20*a*.

As shown in FIG. 9*a*, the fixed support bracket 110 is formed from a sheet metal into a substantially L-section. The vertical flange 111 has a multitude of holes 112 for fixing to the side of a cabinet or chassis into which a drawer or equipment is to be installed in. As described earlier for flange 31, stepped edges 113 are formed on flange 111 for increasing its rigidity. Similarly, notches 114 are formed at the bent edge for increasing the rigidity and load capacity of this bracket.

On the horizontal flange 115 of bracket 110 is attached a fixed guide 120. This guide 120 is formed from a sheet metal into an open C-section similar to the pull-out guide 50 described earlier. Stoppers 121 are punched and formed at either or opposite sides proximate the ends of guide 120. The distance $L_4$ apart between these stoppers 121 determines the travel provided by this slide 20*a*.

Fitted inside guide 120 is a lower roller housing 40*a* similar to the roller housing 40 described in the first embodiment. This housing 40*a* runs smoothly on its rollers 41,42, 43,44 inside guide 120 between the limit stoppers 121.

FIG. 9*d* shows the pull-out slide rail 140. This is formed from a sheet metal into a substantially I-section or a composite of two Ts. Each part of the T is similar to the Trail 33*a* on flange 33 as described in the first embodiment. Of course, the bent edges 141 ,142 of the T-flanges may be on the same side as each other or at opposite sides. On the vertical web 143, adjacent to the T-rails, are formed two sets of stoppers 144, 145 spaced apart by distance $L_5$. At the centre of the vertical flange 143, a roller 147 is mounted on a bracket 148 through a pin or shaft 149. This rail 140 can be installed with no distinction as to which end is forward. Of course, one type of rail 140 can be provided with the tongues of stoppers 144, 145 without being bent yet. These tongues of 144,145 can then be bent in the required direction during assembly or installation. In this way, further flexibility in installation is provided. This also reduces the number of parts required for stocking.

FIG. 9*e* shows the upper roller housing 40*b*, which is similar to housing 40 or 40*a*. Housing 40*b* fits and slides on the upper T-flange of rail 140, whilst housing 40*a* fits and slides on the lower T-flange.

FIG. 9*f* shows the pull-out guide 150, which is similar to guide 50 as described in the first embodiment. Guide 150 fits over and slides on the rollers of housing 40*b*. Stoppers 151 at both ends determine the travel $L_6$ of this sliding guide. Extended bracket 152 at the rear end and an aperture 153 at the front end provide means for attaching this guide 150 to the side of a drawer.

As a variation of the T-rail as in the first embodiment, the flanges on both sides of the central web 143 of pull-out rail 140 may be folded. This follows that the T-recess of roller housing 40*a*, 40*b* are symmetrical, so are the C-section of guides 120, 150.

Once both sides of a drawer, for example, are mounted and fully supported by the sliding guides 20*a*, the drawer can be safely drawn in or out. The opening of the drawer is determined by the distances between the limit stoppers on the various components of this slide and is given by $L_4+L_5+L_6-3L_2$. FIG. 14 illustrates a drawer at an intermediate open position. With this embodiment, it is possible to provide even some over-travel with two stages of telescopic extension of the sliding guide. It is possible to provide further over-travel with more stages of extension, depending on the loading capacity and rigidity required for a particular application.

FIG. 10 shows a third embodiment of a sliding rail 20*b* in which the rail is mounted below the drawer rather than at the sides. With this arrangement, the vertical height of the slide assembly 20*b* is preferably kept low, so that the available height in the drawer is not sacrificed. This assembly 20*b* comprises a fixed support bracket 30*a*; roller housing 40*c*; intermediate pull-out guide 160; roller housing 170; and pull-out guide 180. FIG. 11 is a sectional view of this embodiment, whilst FIG. 12 is a perspective view of slide assembly 20*b*.

Figures 13A, 13B, 13C, 13D, 13E:
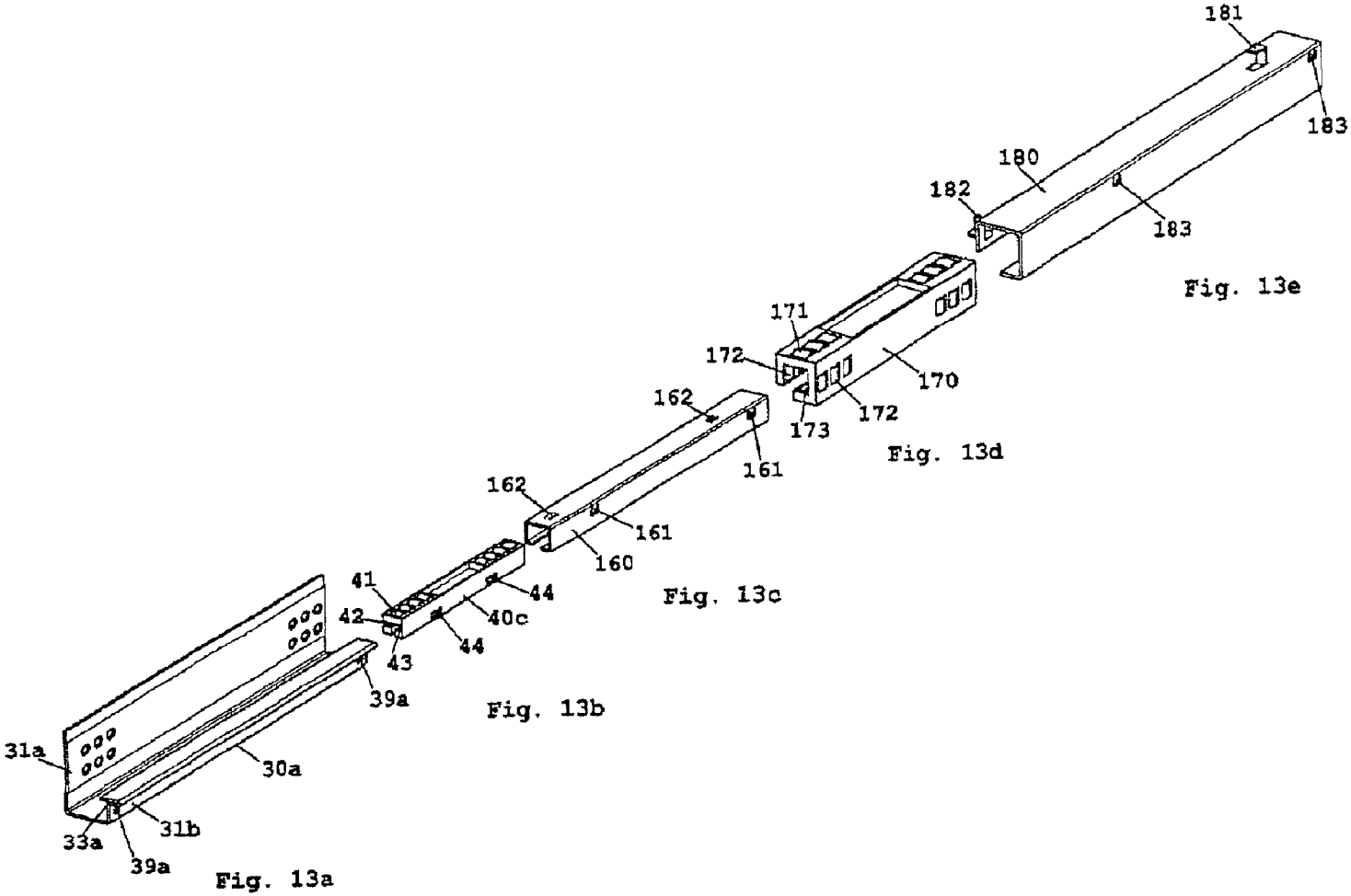

As shown in FIG. 13*a*, support bracket 30*a* is similar in construction with bracket 30. However, the heights of vertical flanges 31*a*, 31*b* are shorter and are kept to the minimum possible and is formed from a sheet metal. The T-rail 33*a* is also similar to that described for the previous embodiments.

FIG. 13*b* shows the roller housing 40*c* which is similar to the roller housing 40, 40*a* or 40*b* described above. With similar function, housing 40*c* fits onto the T-rail 33*a* of bracket 30*a* and slides smoothly thereon between stoppers 39*a*.

As shown in FIG. 13*c*, pull-out guide 160 is similar in construction with previous guides 50, 120 or 150. On the side flanges are two stoppers 161, one towards each end. The tongues of these stoppers 161 are bent inward. On the upper horizontal flange are two further stoppers 162, also one towards each end. However, the tongues of 162 are bent outward.

Roller housing 170 is a long and hollow member with a cross-section of a C with only one lip (as shown in FIG. 13*d*). There are rollers 171, 172, 173 on the top surface, sides and lip respectively. Depending on the design load, length of housing 170 and over-travel, at least one type of each roller 171, 172, 173 is provided at each of these surfaces. The rollers are sized bigger than the support parts of housing 170 such that housing 170 fits onto pull-out guide 160 and runs smoothly on these rollers 171, 172, 173.

FIG. 13*e* shows another pull-out guide 180. This is also formed from a sheet metal and has a C-section with only one lip. On the top surface and at the rear end is punched and formed an L-bracket 181 for fixing with an attachment on the drawer. At the forward end but on the side flange is punched and formed a bracket 182 for fixing to the front part of the drawer. On each or both the sides are formed a pair of typical stoppers 183. This guide 180 fits over roller housing 170 and allows 170 to move smoothly therein between stoppers 183.

Once the drawer/equipment 10 is attached to guide 180 and supported by slide 20*b*, the drawer/equipment can be drawn in or out with little effort as the component parts of slide 20*b* run smoothly on rollers between their respective limit stoppers. FIG. 15 illustrates such a drawer at an intermediate open position.

While only a few embodiments and variations of a sliding guide have been described and illustrated, it is to be understood that many changes and modifications could be made to the present invention without departing from the scope of the present invention. A modification such as the T-rail oriented in the lateral direction is possible. Also instead of rollers 42, 43 and 44, which are not subjected to heavy loads, plain sliding strips made of low friction materials may be used.

What is claimed is:

1. A sliding guide assembly supporting a drawer/equipment for slidably opening and closing within a cabinet or chassis comprising:

a mounting bracket in the form of an L-section having a vertical flange for mounting to a part of said cabinet or chassis and a horizontal flange;

a rail flange perpendicularly mounted to said horizontal flange, having one edge formed into a T-rail, and adjacent said T-rail is formed a first pair of limit stoppers;

a sliding housing having sliding means, arranged to fit on said T-rail and being operable to slide smoothly thereon, with the distance of travel limited between said first pair of limit stoppers; and a pull-out guide having a C-section arranged to fit over said sliding housing, and being operable to slide smoothly therewith between a second pair of limit stoppers;

wherein the pull-out guide is mounted to the drawer/equipment, the potential travel of said pull-out guide in relation to the rail flange is given by the total distances between the first pair of limit stoppers on said T-rail and the second pair of limit stoppers on said pull-out guide minus twice the length of said sliding housing.

2. The sliding guide assembly according to claim 1, wherein the mounting brackets is formed from a sheet metal.

3. The sliding guide assembly according to claim 1, wherein the guide is formed from a sheet metal.

4. The sliding guide assembly according to claim 1, wherein the rail flange is formed from a sheet metal.

5. The sliding guide assembly according to claim 1, wherein the T-rail has flanges of equal width on both sides of the rail flange.

6. The sliding guide assembly according to claim 5, wherein the T-rail is formed with one flange folded.

7. The sliding guide assembly according to claim 1, wherein said rail flange is connected to said horizontal flange.

8. The sliding guide assembly according to claim 7, wherein said rail flange and said horizontal flange are connected to be substantially perpendicular to each other.

9. The sliding guide assembly according to claim 1, wherein said pull-out guide is fixedly attached to said drawer/equipment and said rail flange is fixedly mounted to said mounting bracket.

* * * * *